US006668143B2

(12) United States Patent
Ito

(10) Patent No.: US 6,668,143 B2
(45) Date of Patent: Dec. 23, 2003

(54) IMAGE FORMING APPARATUS

(75) Inventor: Masahiro Ito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 10/093,030

(22) Filed: Mar. 8, 2002

(65) Prior Publication Data

US 2002/0131785 A1 Sep. 19, 2002

(30) Foreign Application Priority Data

Mar. 14, 2001 (JP) ..... 2001-073200

(51) Int. Cl.[7] ..... G03G 15/00; G03G 15/02
(52) U.S. Cl. ..... 399/44; 399/50
(58) Field of Search ..... 399/44, 50, 94, 399/97, 174, 176

(56) References Cited

U.S. PATENT DOCUMENTS 4,422,749 A 12/1983 Hoshino et al.
5,805,954 A * 9/1998 Takahashi ..... 399/44
5,966,558 A * 10/1999 Kikui

* cited by examiner

*Primary Examiner*—Hoang Ngo
(74) *Attorney, Agent, or Firm*—Fitzpatrick, Cella, Harper & Scinto

(57) ABSTRACT

The image forming apparatus has charging device, developing device, transfer-charging device, and control device for controlling a charging bias applied to the charging device. In the image forming apparatus, the transferring material to which the developer image is transferred is separated from the photosensitive body by the transfer-charging device, and the control device reduces the charging bias such that a surface potential of the photosensitive body in the case where the developer image is formed on the transferring material having low rigidity is lower than the surface potential of the photosensitive body in the case where the developer image is formed on the transferring material having high rigidity.

14 Claims, 7 Drawing Sheets

VD0
+340V
VB0
+260V
VC0
+50V
VL0

VD1
+240V
VB1
+160V
VC1
+10V
VL1
POTENTIAL OF PHOTOSENSITIVE DRUM

IMAGE FORMING APPARATUS

BACKGROUND OF THE INVENTION

1. Field of the Invention

The present invention relates to an image forming apparatus using an electrophotographic system, in particular to an image forming apparatus such as a copying machine, a printer or a facsimile.

2. Related Art

For example, in an image forming apparatus such as a digital copying machine or a printer using an electrophotographic system, a one-component magnetic non-contact developing method is often used in which a maintenance interval is long and also a structure is relatively simple. This developing method is one in which load given to a photosensitive drum that is an image bearing member and a driving system by performing non-contact developing is little and which is suitable for high reliability, but a charge amount of a toner that is a developer is relatively low. Thus, in order to charge a developing image developed on the photosensitive drum, that is, a toner image after developing, the developing method is often combined with pre-transfer charging.

In general, a reversal developing system is often used as a developing system. In the reversal developing system, image exposure corresponding to image information to be printed is conducted to a uniformly charged photosensitive drum surface by using a laser, an LED or the like, to thereby form an electrostatic latent image, and then, the portion where a potential thereof is lowered by having undergone the exposure is made to be adhered with the toner charged with the same polarity as that of the photosensitive drum, to thereby form a toner image.

As a method of transferring the toner on the photosensitive drum, which has been subjected to the reversal developing, onto a transferring material, and separating it, corona transfer and electrostatic separation utilizing a corona charging device is often used. In this method, charging and charge-removal can be conducted while a charging means is in non-contact with the photosensitive drum or the transferring material, and thus, there is little load to a charging member and the photosensitive drum. Therefore, this method provides high reliability.

However, the transferring material such as paper used in the image forming apparatus of the reversal developing system is not always recommended paper designated by a maker, and includes recycled paper, intermediate sheet, special paper and the like. The image forming apparatus is strongly influenced particularly in separating property of the transferring material by a type of the transferring material, temperature and humidity of the apparatus main body, and an image forming mode.

Generally, in the reversal developing system, a background portion of the photosensitive drum surface, that is, the portion to which the toner is not adhered does not undergo exposure, and thus, is still in a high potential state after the toner image formation. Then, in this state, pre-transfer charging is conducted to the toner developed on the photosensitive drum in order to stably improve the toner charge amount. Thus, a surface potential of the photosensitive drum also rises.

Further, in the next transfer process, when the back surface of the transferring material such as a sheet of paper is imparted with a charge with opposite polarity to that of the toner and then the toner is transferred onto the surface of the transferring material, the transferring material is charged with the opposite polarity to that of the toner, that is, the opposite polarity to that of the background portion (non-exposure portion) of the photosensitive drum surface. Thus, a large electrostatic adhesive force is generated between the photosensitive drum and the transferring material, and the subsequent separation of the transferring material from the photosensitive drum becomes difficult. Normally, since a background portion (white ground portion) occupies a larger area than a character portion and the like to which the toner is to be adhered in an image of a document or the like, the electrostatic adhesive force is particularly large, and the separation is difficult.

The above-described problem that occurs in the image forming apparatus is prevented by adjusting charging conditions or transfer conditions in the case where recommended paper designated by a maker which is a high rigidity transferring material is used as a transferring material. However, in the case where a low rigidity transferring material such as recycled paper or intermediate sheet is used, there occurs a problem of malfunction of separation from the photosensitive drum. Further, the image forming apparatus is largely influenced by temperature and humidity of the apparatus main body, and furthermore, various printing methods such as double-sided printing and multiple printing are conducted to the above transferring materials. Therefore, actions such as transfer, separation, fixing and conveyance are imparted to a sheet of transferring material many times so that the characteristics of the transferring material (resistance, surface property, curl and the like) change. Thus, it has been difficult to maintain stable conveying property (at the time of transfer separation) and image property in the apparatus.

SUMMARY OF THE INVENTION

The present invention has been made in view of the above, and an object of the present invention is therefore, even in the case where an image is formed on a transferring material having low rigidity, such as recycled paper or intermediate sheet, to provide an image forming apparatus capable of satisfactorily separating such a transferring material from a photosensitive body.

Another object of the present invention is, even in the case where an image is formed on a second surface of a transferring material, to provide an image forming apparatus capable of satisfactorily separating the transferring material from a photosensitive body.

Other objects of the present invention will be apparent from the following detailed description referring to the attached drawings.

DESCRIPTION OF THE PREFERRED EMBODIMENTS

Hereinafter, an image forming apparatus according to the present invention will be described more in detail referring to the accompanying drawings.

Embodiment 1

Figure 1:
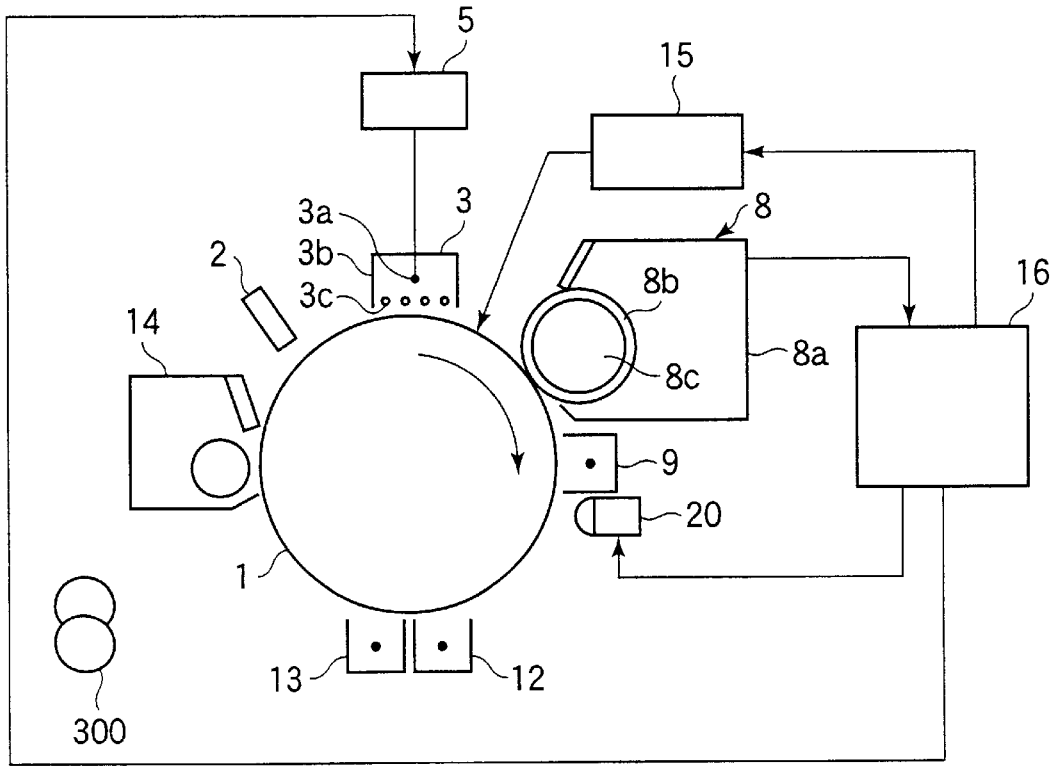
FIG. 1 is a schematic structural diagram of an image forming apparatus according to the present invention.

First, a main part for conducting image formation is described referring to FIG. 1. FIG. 1 shows the structure of the main part for conducting image formation of the image forming apparatus having a printer function and a copying function for forming a binary image of 600 dpi with turning ON/OFF of a laser in accordance with this embodiment.

A photosensitive body having an image region where an image is formed on a surface thereof (corresponding to a region where a transferring material contacts the photosensitive body with the surface (equivalent of an area of the transferring material)) comprises a photosensitive drum 1. The photosensitive drum 1 has a photosensitive layer made of a-Si with a diameter of 108 mm, and is rotatively driven in a clockwise direction in FIG. 1 at a peripheral speed of 450 mm/sec by a drum motor (not shown).

In a pre-exposure apparatus 2 disposed in the vicinity of an outer circumference of the photosensitive drum 1, 64 light emitting devices (LEDs) having a wavelength of approximately 660 nm for removing a residual charge are arranged in a line. With this arrangement, the residual charge on the photosensitive drum 1 due to the previous image formation is removed to prepare the next image formation.

A primary charging device 3 as a charging means positioned at the downstream of the pre-exposure apparatus 2 in a rotational direction of the photosensitive drum 1 is connected to a high voltage power source 5, and is constituted of a tungsten wire 3*a* as a discharge electrode which has a diameter of approximately 60 $\mu$m and which is subjected to an oxidization process on its surface, a metal shield 3*b*, and a metal wire grid 3*c* electrically connected to the metal shield 3*b*.

The surface of the photosensitive drum 1 is uniformly charged to a predetermined potential (positive polarity) by the primary charging device 3, and is exposed by an image exposing apparatus 15, thereby forming an electrostatic latent image. The image exposing apparatus 15 exposes the surface of the photosensitive drum 1 after charging by the primary charging device 3 with turning ON/OFF of a laser to thereby form a light portion potential. Incidentally, a bias in which a DC bias is superimposed on an AC bias is applied to the primary charging device at the time of charging. Further, "charging bias" described later indicates a DC bias.

A developing apparatus 8 as a developing means positioned at the downstream of an exposure part in the rotational direction of the photosensitive drum 1 is composed of a developing container 8*a* and a developing sleeve 8*b*.

A one-component magnetic developer (toner) as a developer is contained in the developing device 8*a*, and the developing device 8*a* is provided with an opening portion so as to oppose the photosensitive drum 1, the developing sleeve 8*b* being provided in the opening portion. The developing sleeve 8*b* is provided with a magnet roller 8*c* having six poles in its interior, and is a metal sleeve having a diameter of approximately 32 mm with its surface subjected to metal plating.

In this embodiment, in the developing apparatus 8, a one-component magnetic positive toner having an average particle size of 7 $\mu$m is carried in the developing sleeve 8*b* as a developer in the developing device 8*a*. After primary charging, image exposure is conducted to the photosensitive drum 1 by the image exposing apparatus 15. Then, the toner is adhered to the image exposure part having been exposed by the image exposing apparatus 15, that is, the region of an image portion potential in an electrostatic latent image. Incidentally, the bias in which a DC bias is superimposed on an AC bias is applied to the developing sleeve of the developing apparatus at the time of developing. Further, "developing bias" described later indicates a DC bias.

The image region, where a toner image is formed, on the photosensitive drum 1 is imparted with a positive charge by a pre-transfer charging device 9 positioned at the downstream of the developing apparatus 8 in the rotational direction of the photosensitive drum 1. With this arrangement, triboelectricity (charge amount per unit weight) of the toner on the photosensitive drum 1 is increased, and the toner image on the photosensitive body becomes easy to be attracted to the transferring material at the time of transfer, that is, the toner becomes easy to be adhered to the transferring material, whereby transfer efficiency of the toner image from the photosensitive body to the transferring material is improved. At this time, a background portion (non-image portion) in the image region to which the toner is not adhered is simultaneously charged. There is a tendency that this becomes a cause of the reduction in separating property of the transferring material described later.

Incidentally, the pre-transfer charging device 9 (corona charging device) arranged in non-contact with the photosensitive drum is applied with a predetermined bias with a frequency of 2000 Hz, in which a DC voltage (positive polarity) is superimposed on a high voltage having an amplitude of approximately 7.6 kV, by a high voltage power source (not shown) to be driven. Further, a DC value of the bias applied to the pre-transfer charging device is kept substantially constant irrespective of rigidity of the transferring material on which an image is formed.

After charging of the image region, where the toner image is formed, on the photosensitive body by the pre-transfer charging device 9 and before transfer of the toner image to the transferring material, the image region is exposed by a pre-transfer exposing apparatus 20 as an exposing means. Thus, the potential of the non-image portion (background portion to which the toner is not adhered) in the image region is lowered. The potential of the image portion, where the toner image is formed, in the image region is hardly attenuated since the toner intervenes on the photosensitive layer. This is for preventing, in the case where an image is formed on a sheet of paper having low rigidity (for example, a sheet of thin paper), such a sheet from electrostatically and strongly being attracted to the photosensitive drum to be wounded around the drum, thereby causing separation malfunction at the time of transfer.

Further, when exposure intensity of the pre-transfer exposing apparatus is raised too much, the potential of the non-image portion is excessively lowered. Thus, the image portion (toner image) is surrounded by the potential of the non-image portion, whereby scattering of the toner image (at the time of transfer and separation) cannot be suppressed.

Therefore, in this embodiment, the pre-transfer exposing apparatus is controlled by a control device so as to keep the exposure intensity at an appropriate level.

Thereafter, the toner image formed on the surface of the photosensitive drum 1 is transferred to a sheet of paper as the transferring material by a transfer-charging device 12 as a transfer-charging means to which a transfer bias (DC voltage with negative polarity) is applied from a power source. At the time of transfer, the transferring material is conveyed while contacting the photosensitive drum.

Next, the transferring material is separated from the photosensitive drum 1 by a separation-charging device 13 as a separation-charging means. A charging line (charging wire) of the separation-charging device 13 is applied with a voltage in which a DC voltage is superimposed on a voltage having an amplitude of 10.0 kVpp (peak-to-peak voltage) and which is a rectangular wave having a frequency of 2000 Hz.

As to the transferring material separated from the photosensitive drum, the toner image is heated while being pressurized onto the transferring material to be fixed by a fixing apparatus 300. In the fixing apparatus 300, a pair of rollers is provided which is composed of a lower side pressurizing roller and an upper side fixing roller (roller on the side that contacts a toner image) in FIG. 1. An elastic layer is provided as a surface layer of the fixing roller taking fixing property into consideration. Thus, a fixing nip has a convex shape as shown in FIG. 1.

Further, at the time of fixing, there is a tendency that the transferring material is given with a curl such that leading and rear ends of the transferring material in a conveyance direction turn downward (in FIG. 1).

Therefore, in the case where images are successively formed on a first surface and a second surface that is the back surface of the transferring material, when the transferring material, which has been fixed with the toner image on its first surface and then given with the curl, is reversed and conveyed to a transfer portion again, the transferring material may be wound around the photosensitive drum to thereby frequently cause separation malfunction. It can be considered that this is because the curvature of the curl given to the transferring material matches that of the photosensitive drum.

A cleaning apparatus 14 removes the toner remaining on the photosensitive drum 1 after transfer. The surface of the photosensitive drum 1 having been cleaned passes through the pre-exposure apparatus 2 and the charging device 3 to thereby form the next image.

Further, the above-mentioned electrophotographic image forming process (image forming process) including the charging, exposure, developing, transfer and the like is performed in accordance with signals of a control device 16 that is a control means for controlling the entire apparatus.

Figure 2:
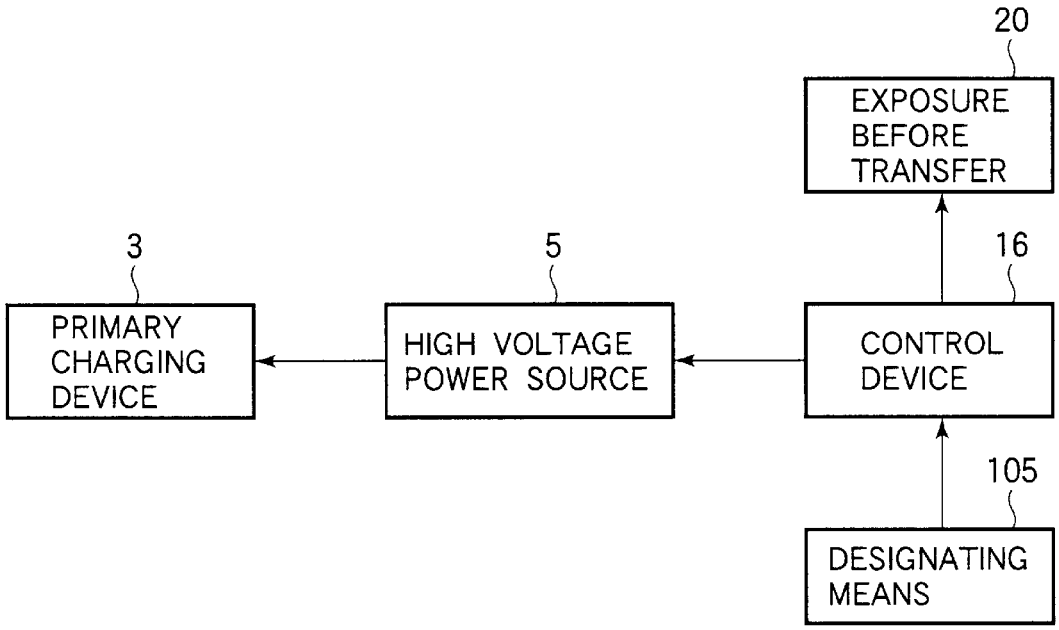
FIG. 2 is a block diagram in accordance with an embodiment of the present invention.

FIG. 2 is a block diagram showing the procedure of the image forming start process of this embodiment. A control signal designating a charge amount is transmitted from the control device 16 to the high voltage power source 5 serving as the charging apparatus. The high voltage power source 5 drives the primary charging device 3 for uniformly charging the surface of the photosensitive drum 1 in accordance with the control signal, thereby being capable of making the potential of the photosensitive drum variable.

A designating means 105 is an input or select key provided in a liquid crystal operation panel or the like of the image forming apparatus. With the use of this key, a user designates that the transferring material to be used is a transferring material having a characteristic of low rigidity such as intermediate sheet or recycled paper by using the key.

Then, in this embodiment, information about the transferring material to be used having low rigidity (designation of intermediate sheet, recycled paper or the like) is transmitted to the control device 16 by the designating means 105, and a start key (not shown) for image formation is turned ON. Then, for example, the control device 16 sets the charging bias to 70% of a standard value thereof, thereby conducting primary charging operation.

Figures 3A, 3B:
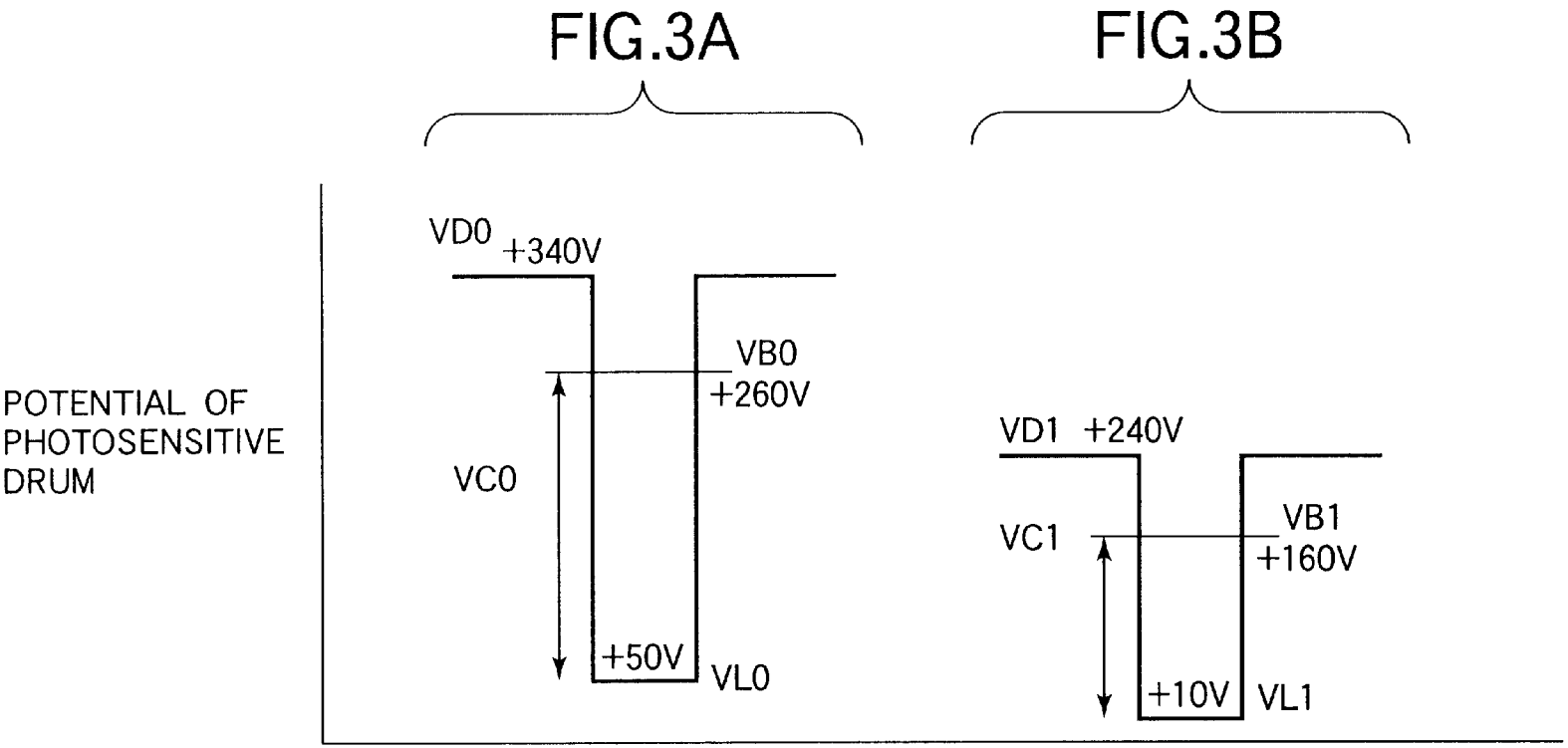
FIGS. 3A and 3B are diagrams for explaining change and contrast of an image bearing member charging potential (VD) of a conventional example and of an example in accordance with the present invention, respectively.

Referring to FIG. 3, the potential of the photosensitive drum 1 in the image forming process in the case where the low rigidity transferring material such as intermediate sheet or recycled paper is designated as the transferring material as in this embodiment is shown in comparison with the normal case where recommended paper designated by a maker which is the high rigidity transferring material is used.

At the time of image formation, in the case where the high rigidity transferring material, for example, CLC 80 gr made by Canon Inc. or Kangas made by Canon Inc. is used as the transferring material, an example of the procedure is shown in FIG. 2A. Namely, in general, after the photosensitive drum 1 is uniformly charged to VD0 (=+340 V), laser exposure is conducted to the portion where a toner image is to be formed to lower the potential to VL0 (=+50 V) to thereby form an electrostatic latent image, and a developing bias VB0 (=+260 V) is applied to the developing sleeve 8*b* carrying the developer. Then, the toner is adhered to the VL0 portion with an electric field based on a potential difference VC0=VB0−VL0=210 V (Hereinafter, the potential difference is referred to as "contrast".) between the developing sleeve 8*b* and the photosensitive drum 1 (image portion potential), thereby forming a toner image.

On the other hand, in this embodiment, intermediate sheet (trade name SM-1 made by Canon Sales Co., Inc.), for example, is used as the low rigidity transferring material. As shown in FIG. 2B, the charge amount is set to 70% of the normal charge amount to charge the photosensitive drum to a potential VD1=VD0×70/100 (=+240 V). Then, image exposure is conducted with the same exposure amount as the normal exposure amount to lower the potential of the photosensitive drum to VL1 (=+10 V). Next, the developing bias is set to VB1 (=+160 V) in expectation of margin for removing fog. Thus, the toner is adhered to the VL1 portion with a contrast VC1=VB1−VL1=150 V, thereby forming a toner image.

Figure 4:
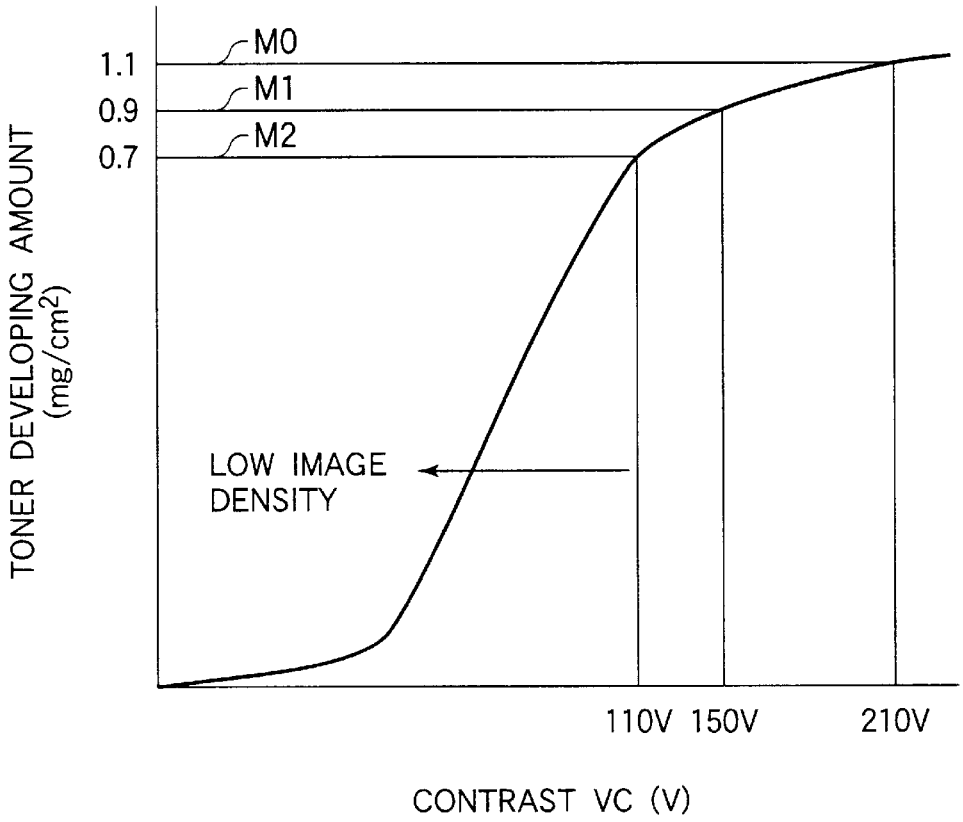
FIG. 4 is a diagram for explaining the relationship between contrast and a toner developing amount.

Here, FIG. 4 shows the relationship between the contrast and a toner developing amount of the toner to the photosensitive drum 1 due to developing. The toner developing amount indicates the amount of the toner developed on the photosensitive drum 1, that is, the adhesion amount of the developer in the case where the entire black image is formed. FIG. 4 is a graph in the case where the toner developing amount is measured by changing the primary charge amount while keeping the laser exposure amount of the image exposing apparatus 15 and the developing bias VB constant, thereby changing the charging potential VD.

As seen from the graph, while the toner developing amount M0 is 1.1 mg/cm$^2$ in the normal latent image formation (contrast 210 V), the toner developing amount M1 is 0.9 mg/cm$^2$ in the latent image formation in this embodiment (contrast 150 V). However, there is almost no change in image density between the two cases, and a satisfactory image is obtained.

However, if the contrast is further lowered, and the contrast becomes less than 110 V (M2), the toner developing amount is 0.7 mg/cm$^2$, which means that the image density is low. Thus, in this embodiment, VD1 is set to 240 V in expectation of various allowances in order to obtain the charge amount with which the contrast is not less than 110 V.

Taking into consideration improvement of separating property by lowering of the image density, that is, the contrast, the toner developing amount of the toner image formed on the image bearing member is preferably controlled to 0.7 mg/cm$^2$ to 0.9 mg/cm$^2$ (in this embodiment, 0.9 mg/cm$^2$) when the low rigidity transferring material is designated as in this embodiment.

From the above, the following structures are taken:

(1) The VD potential at the time of charging is lowered. (340 V to 240 V)

(2) The contrast is made small to thereby reduce the toner developing amount. (1.1 mg/cm$^2$ to 0.9 mg/cm$^2$)

(3) The contrast is made small, and the transfer bias (transfer current) is reduced in accordance with the contrast.

(4) Along with the reduction of the VD potential, the potential of the background portion (non-image portion) in the image region (image portion and background portion) on the photosensitive drum just before transfer (or just before separation) is lowered by conducting exposure by the pre-transfer exposing apparatus in comparison with the normal case.

In accordance with the above structures, the following merits are obtained with respect to the separating property.

In accordance with (1), the charging bias is reduced to lower VD, and further, in accordance with (2), the developing condition and the exposure condition are adjusted to lower the contrast. Then, the developing toner amount is reduced. Thus, an optimum transfer output can be reduced, and the adhesion force between the photosensitive drum 1 and the transferring material can be reduced.

Figure 5:
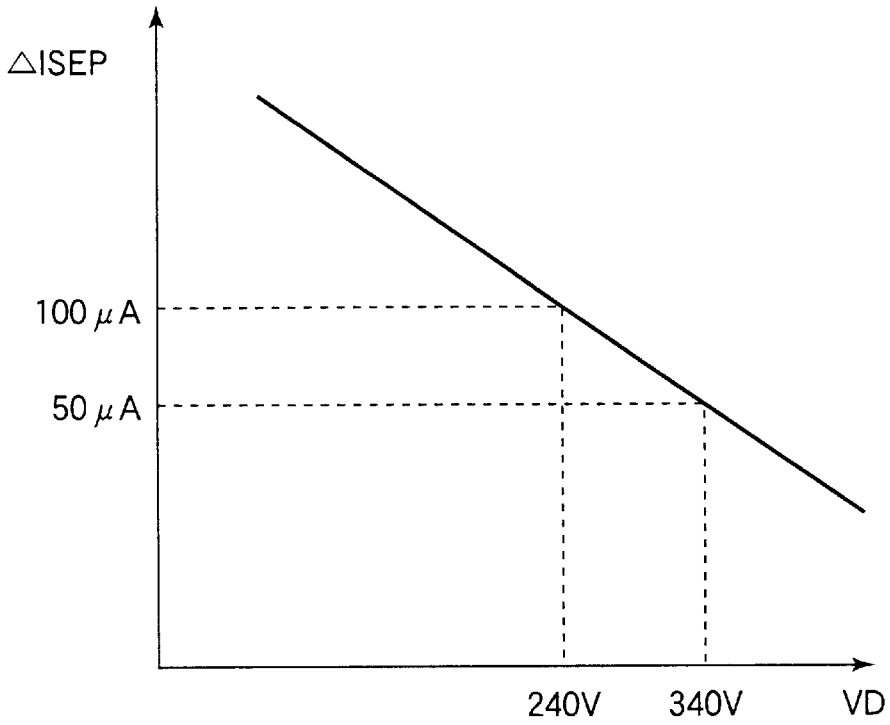
FIG. 5 is a diagram for explaining the relationship between VD and separation stability (ΔIESP)

The effect of (1) is described referring to FIG. 5. FIG. 5 shows the measurement result of change of separating property obtained by changing only VD in the image forming apparatus in this embodiment. Intermediate sheet (trade name SM-1 made by Canon Sales Co., Inc) is used as paper for passing, and a pre-transfer charging difference-current in the pre-transfer charging device 9 is set to +150 $\mu$A and a transfer current in the transferring apparatus 12 is set to −350 $\mu$A. The horizontal axis indicates VD and the vertical axis indicates separation stability. Also, the pre-transfer exposing apparatus is operated at this time.

Here, the definition of the separation stability indicates a separation difference-current width such that a separation difference-current ΔISEP (difference between absolute values of a plus component and of a minus component of discharge due to change of a DC superimposing component) is changed, then, 100 sheets of paper are passed at respective difference-current values, and the transferring material passes through transfer and separation processes without causing separation malfunction of the transferring material and retransfer of the toner to the photosensitive drum 1, thereby satisfactorily obtaining an image on the separated transferring material. The larger the value of ΔISEP is, the higher the separation stability is.

According to FIG. 5, ΔISEP as the index of the separation stability is expanded from 50 $\mu$A to 100 $\mu$A by reducing VD from 340 V to 240 V. Thus, it is seen that the separation stability is apparently improved.

Figure 6:
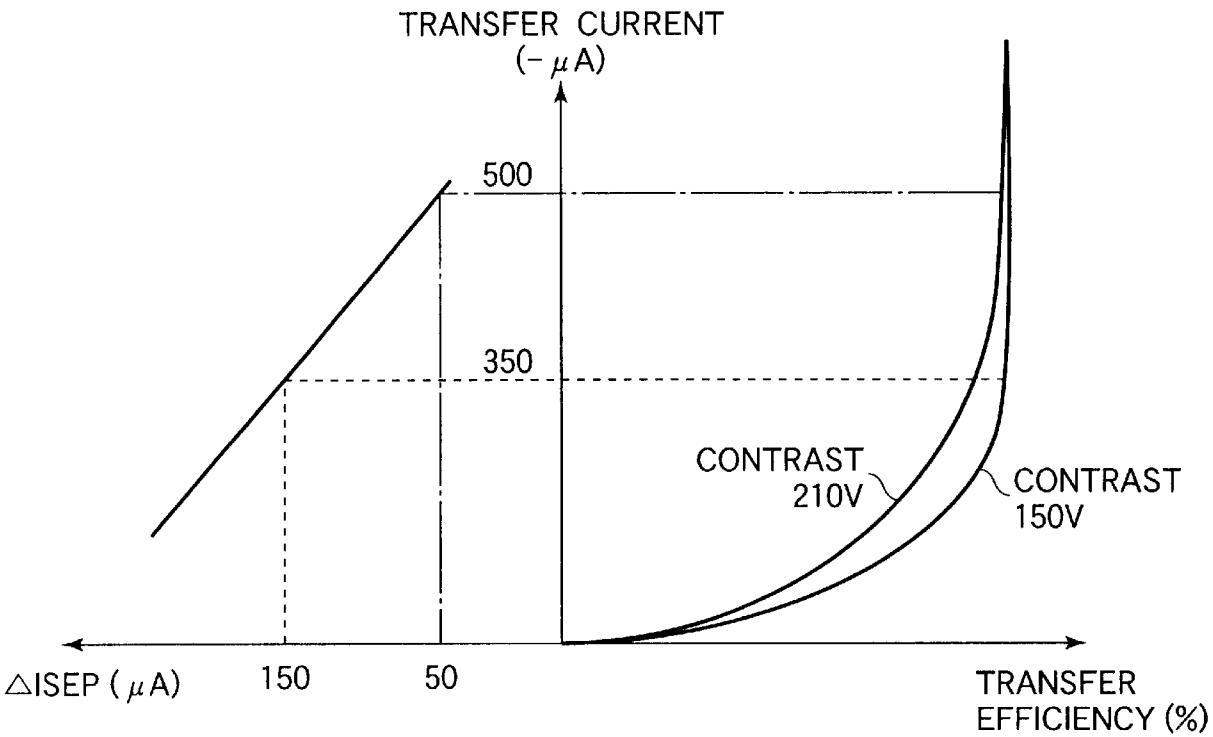
FIG. 6 is a diagram for explaining the relationship between VD, contrast, transfer current setting and separation stability.

Next, the effect of (2) is described referring to FIG. 6. Namely, FIG. 6 shows, besides the effect of reducing VD in (1), the effect of reducing the toner developing amount by lowering of the contrast.

As to the setting condition, in this embodiment with the contrast VC=150 V, intermediate sheet (trade name SM-1 made by Canon Sales Co., Inc) is used with VD=+240 V, VB=+160 V, VL=10V, and the pre-transfer charging difference-current of +150 $\mu$A as described above. Further, in the example of the normal contrast VC=210 V, intermediate (trade name SM-1 made by Canon Sales Co., Inc) is used as a transferring material with VD=+340 V, VB=+260 V, VL=50V, and the pre-transfer charging difference-current of +150 $\mu$A.

The right side of FIG. 6 shows the relationship between a transfer current and transfer efficiency for two cases of contrast in a normal case (210 V) and in this embodiment (150 V). In the normal case where the contrast is high, since the more amount of developed toner has to be transferred, the transfer efficiency is slow in getting sufficiently raised with respect to the transfer current, and the transfer current needs to be set to −500 $\mu$A. On the other hand, in this embodiment, since the amount of the toner to be transferred is small, a sufficient efficiency can be obtained with a transfer current of −350 $\mu$A corresponding to 70% of the normal transfer current. Thus, the contrast is lowered to reduce the toner developing amount not less than 60% and less than 100% of that in the normal case, whereby the transfer current can also be reduced.

As to the effect of (3), the left side of the graph shows the separation difference-current width ΔISEP that is the index of the separation stability by using the contrast and transfer current used in the right side. The graph shows that ΔISEP in the case where the contrast and transfer current in this embodiment are reduced (−350 $\mu$A) expands to 150 $\mu$A while ΔISEP in the case where the normal contrast and transfer current (−500 $\mu$A) are used is 50 $\mu$A.

Generally, ΔISEP that is the index of the separation stability can be said practical at 100 $\mu$A or more. Thus, as in this embodiment, the following means are taken in which: (1) VD is reduced. (2) The contrast is lowered. (3) The transfer current is lowered. Accordingly, practical transfer separation can be sufficiently and stably performed even with the intermediate sheet having low rigidity which tears easily as the transferring material.

Further, as to the effect of (4), in case of using the low rigidity transferring material, the potential VD of the photosensitive drum is reduced in comparison with the case of the high rigidity transferring material, and thus, the potential of the background portion of the image region, that is, the potential of the leading end side (corresponding to a blank portion at the leading end in the conveyance direction of the transferring material) of the image region is lowered by the pre-transfer exposing apparatus. Therefore, the leading end of the transferring material becomes difficult to wind around the photosensitive drum, as a result of which the separating property of the transferring material from the photosensitive drum is improved. Further, at this time, since the exposure intensity of the pre-transfer exposing apparatus is set at substantially the same level as that in the case where an image is formed on the high rigidity transferring material, scattering of the toner image can be suppressed in the case where an image is formed on the low rigidity transferring material.

In actuality, 100 sheets of intermediate sheet (trade name SM-1 made by Canon Sales Co., Inc) were successively passed with the above-described setting in this embodiment.

As a result, image formation could be conducted with stable transfer separation.

As described above, in accordance with this embodiment, at the time of designation of intermediate sheet or recycled paper, along with the designation, the exposure condition and the developing condition are adjusted, and the charging condition is changed, thereby lowering the potential of the image bearing member surface and setting the image forming condition. Also, the transfer condition is changed to lower the transfer current. Thus, stable transfer and separation can be conducted.

Here, when the low rigidity transferring material is designated as in this embodiment, in consideration for the relationship between VD, contrast and image density, the charging bias is reduced by the control device 16 such that VD of (1), that is, the surface potential of the charged image bearing member is 50% to 70% (70% in this embodiment) of that in the normal case where the high rigidity transferring material is designated. Then, also when the transfer current of (3) is reduced, it is preferable that the transfer condition is controlled by the control device 16 such that the transfer current is 60% to 100% (70% in this embodiment) of that in the normal case where the high rigidity transferring material is designated, in proportion to the changed VD in (1). Further, it is preferable that the image region where the toner image is formed on the photosensitive drum is exposed by operating the pre-transfer exposing apparatus, whereby the potential of the non-image portion in the image region just before transfer is lowered.

Incidentally, as the high rigidity transferring material, one having Clark stiffness projected length (JIS P8143) of 20 to 30 cm, such as CLC 80 gr made by Canon Inc. or Kangas made by Canon Inc. is used. On the other hand, as the low rigidity transferring material, besides the intermediate sheet (trade name SM-1 made by Canon Sales Co., Inc) used in this embodiment, recycled paper, EN100 made by Canon Inc., other thin paper having severe separating property, and the like which have Clark stiffness projected length not less than 10 cm and less than 20 cm can be applied as long as the same control as in this embodiment is conducted.

Further, this embodiment has been described using the reversal developing, pre-transfer charging, and corona transfer separation, but is not particularly limited to the above. This embodiment can also be applied to known electrophotographic means.

Embodiment 2

The image forming condition and the transfer condition are changed in accordance with the designation of the paper type in Embodiment 1. However, in this embodiment, the image forming condition and the transfer condition are changed and used in accordance with the designation of the paper type and also a temperature and humidity environment in which the paper is used.

Hereinafter, description will be made using the drawing. Note that substantially the same image forming apparatus as that in FIG. 1 described in Embodiment 1 can be used as the image forming apparatus applied to this embodiment. Thus, only parts different from those in Embodiment 1 will be described.

Figure 7:
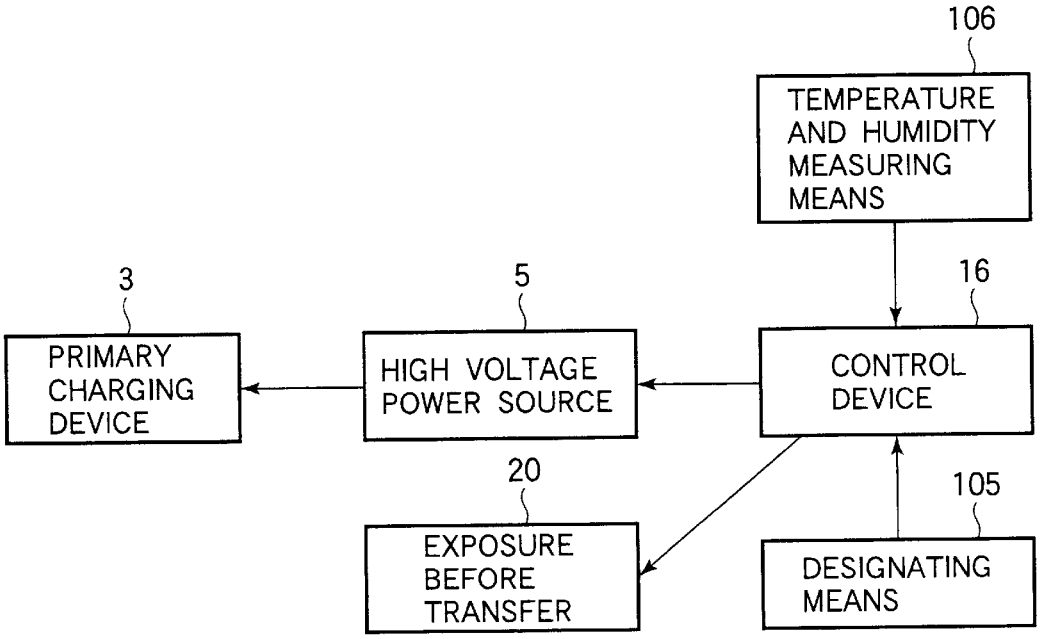
FIG. 7 is a block diagram in accordance with another embodiment of the present invention.

As understood from a block diagram of an image formation start system of FIG. 7, in addition to the designation of the paper type, a signal from a temperature and humidity sensor 106 that is a temperature and humidity detection means for detecting temperature and humidity of an atmosphere in the image forming apparatus main body is input to the control device 16. In the control device 16, an absolute moisture amount is calculated based on signal information from the temperature and humidity sensor 106.

In this embodiment, only in the case where recycled paper is designated for the paper type (for example, trade name EN100 made by Canon Sales Co., Inc.), and also, it is judged that the calculated absolute moisture amount is 16 gr/kg or more, which means high humidity, in accordance with the detection signal from the temperature and humidity sensor, the latent image forming condition is changed as in Embodiment 1 such that: VD is changed from +340 V to +240 V, the contrast is changed from 210 V to 150 V, and the transfer current is changed from −500 $\mu$A to −350 $\mu$A. Thus, the potential of the non-image portion in the image region, where the toner image is formed, on the photosensitive drum just before transfer is lowered.

The reason the absolute moisture amount is changed over at 16 gr/kg is that the used transferring material absorbs moisture more and becomes easier to tear as the environment has higher humidity, which leads to unstable separating property. In particular, this is conspicuous in the case where the low rigidity transferring material like recycled paper originally easy to tear which is described in Embodiment 1 is used.

In the image forming apparatus in this embodiment, ΔISEP as the index in the above condition was obtained. As a result, ΔISEP that had been 80 $\mu$A expanded to 200 $\mu$A.

Then, in the environment with an absolute moisture amount of 21 gr/kg, recycled paper (trade name EN100 made by Canon Sales Co., Inc.) was designated, and 500 thousands sheets of the paper were actually passed. As a result, image formation could be conducted by stable transfer separation without occurrence of separation malfunction, retransfer and the like.

Note that, also in this embodiment, the same image formation control can be applied even with the designation of other thin paper having severe separating property or curled paper.

Here, the changeover point between the absolute moisture amount equivalent to high humidity and the absolute moisture amount not equivalent to high humidity can be set at 16 gr/kg or more.

The potential of the non-image portion in the image region, where the toner image is formed, on the photosensitive drum just before transfer may be lowered in accordance with the image forming mode (at the time of image formation on the second surface in the case where image formation is conducted to both surfaces of the transferring material, which is in a situation that the separating property is severer) besides the atmosphere moisture amount as the setting condition.

To the contrary, the pre-transfer exposing apparatus is operated while the charging condition is changed in accordance with a single condition such as the above environmental condition or the above image forming mode, whereby the potential of the non-image portion in the image region, where the toner image is formed, on the photosensitive drum just before transfer may be lowered as in Embodiment 1. In accordance with this, the transfer condition is preferably changed.

Further, the potential of the non-image portion in the image region, where the toner image is formed, on the photosensitive drum just before transfer may be lowered as in Embodiment 1 in accordance with both the environmental condition and the image forming mode as in Embodiment 2. For example, when the double-sided printing mode in which separating property is severer is designated for the image forming mode, the image forming condition is changed as in the above at the time of printing of the second surface so that the surface potential of the image bearing member is made to be 70% of that of the high rigidity transferring material. Thus, the transfer output is lowered, thereby similarly improving the separating property.

Note that, differently from the cases of Embodiment 1 and 2, the image forming apparatus may be used in which a photosensitive drum of a negative charging characteristic is used. In this case, only the polarities of the toner, primary charging bias, developing bias, pre-transfer charging bias, transfer bias and the like are opposite to those in the above embodiments in accordance with the above image forming apparatus. The present invention can also be applied to the image forming apparatus. Namely, although it is described in the above embodiments that the primary charging bias (DC value), developing bias (DC value), transfer bias and the like are reduced, taking the modified example into consideration, "reduction" is entirely the meaning of "reduction in an absolute value".

As described above, in accordance with the above embodiments, the pre-transfer exposing apparatus is operated while the charging bias is controlled in accordance with at least one of the rigidity of the transferring material, the environmental condition, and the image forming mode, whereby the potential of the non-image portion in the image region, where the toner image is formed, on the photosensitive body just before transfer is lowered. Thus, the separation malfunction of the transferring material from the photosensitive body is prevented, thereby being capable of attaining stability of the separation.

What is claimed is:

1. An image forming apparatus comprising:

charging means for charging a surface of a photosensitive body to form an electrostatic latent image on the photosensitive body;

developing means for developing the electrostatic latent image on the photosensitive body with a developer;

transfer-charging means for transferring a developer image on the photosensitive body onto a transferring material in a state that the photosensitive body contacts with the transferring material; and wherein the transferring material to which the developer image is transferred is separated from the photosensitive body by said transfer-charging means, and control means for controlling a charging bias applied to said charging means;

wherein said control means reduces the charging bias such that a surface potential of the photosensitive body in a case where the developer image is formed on the transferring material having low rigidity is lower than a surface potential of the photosensitive body in a case where the developer image is formed on the transferring material having high rigidity.

2. An image forming apparatus according to claim 1, wherein said control means reduces the charging bias such that the surface potential of the photosensitive body in the case where the developer image is formed on the transferring material having low rigidity is 50% to 70% of the surface potential of the photosensitive body in the case where the developer image is formed on the transferring material having high rigidity.

3. An image forming apparatus according to claim 1 or 2, further comprising exposing means for exposing an image region where the developer image is formed by said developing means, wherein said control means controls the surface potential of the photosensitive body by controlling the charging bias together with operating said exposing means.

4. An image forming apparatus according to claim 3, wherein said control means reduces a developing bias applied to said developing means such that a difference between a potential of an image portion in the electrostatic latent image in the case where the developer image is formed on the transferring material having low rigidity and the developing bias applied to said developing means is smaller than that in the case where the developer image is formed on the transferring material having high rigidity.

5. An image forming apparatus according to claim 4, wherein said control means performs controlling such that a transfer bias applied to said transfer-charging means in the case where the developer image is formed on the transferring material having low rigidity is smaller than the transfer bias in the case where the developer image is formed on the transferring material having high rigidity.

6. An image forming apparatus according to claim 1, wherein the rigidity is projected length of a Clark stiffness, the projected length of the transferring material having high rigidity is 20 cm to 30 cm, and the projected length of the transferring material having low rigidity is not less than 10 cm and less than 20 cm.

7. An image forming apparatus according to claim 1, wherein said developing means reversal-develops the electrostatic latent image formed on an image region.

8. An image forming apparatus comprising:

charging means for charging a surface of a photosensitive body to form an electrostatic latent image on the photosensitive body;

developing means for developing the electrostatic latent image on the photosensitive body with a developer;

transfer-charging means for transferring a developer image on the photosensitive body onto a transferring material in a state that the photosensitive body contacts with the transferring material;

fixing means for heating and pressurizing the developer image to the fix the developer image onto transferring material after the transferring material, to which the developer image is transferred by said transfer-charging means, is separated from the photosensitive body; and wherein after the developer image is fixed on a first surface of the transferring material by said fixing means, the developer image is capable of being transferred to a second surface opposite to the first surface of the transferring material by said transfer-charging means; and control means for controlling a charging bias applied to said charging means;

wherein said control means reduces the charging bias such that a surface potential of the photosensitive body in a case where the developer image is formed on the second surface of the transferring material is lower than a surface potential of the photosensitive body in a case where the developer image is formed on the first surface of the transferring material.

9. An image forming apparatus according to claim 8, wherein said control means reduces the charging bias such that the surface potential of the photosensitive body in the case where the developer image is formed on the second surface of the transferring material is 50% to 70% of the surface potential of the photosensitive body in the case where the developer image is formed on the first surface of the transferring material.

10. An image forming apparatus according to claim 8 or 9, further comprising exposing means for exposing an image region where the developer image is formed by said developing means, wherein said control means controls the surface potential of the photosensitive body by controlling the charging bias together with operating said exposing means.

11. An image forming apparatus according to claim 10, wherein a fixing nip of said fixing means has a shape convex to a side of an unfixed image surface of the transferring material.

12. An image forming apparatus comprising:

charging means for charging a surface of a photosensitive body to form an electrostatic latent image on the photosensitive body;

developing means for developing the electrostatic latent image on the photosensitive body with a developer;

transfer-charging means for transferring a developer image on the photosensitive body onto a transferring material in a state that the photosensitive body contacts with the transferring material;

wherein the transferring material to which the developing image is transferred by said transfer-charging means is separated from the photosensitive body, and detecting means for detecting an atmosphere environment; and control means for controlling charging bias applied to said charging means;

wherein said control means reduces the charging bias such that a surface potential of the photosensitive body in a case where a detection result by said detecting means is high humidity is lower than a surface potential of the photosensitive body in a case where a detection result by the detecting means is low humidity.

13. An image forming apparatus according to claim 12, wherein said control means reduces the charging bias such that the surface potential of the photosensitive body in the case where a detection result by the detecting means is high humidity is 50% to 70% of the surface potential of the photosensitive body in the case where a detection result by the detecting means is low humidity.

14. An image forming apparatus according to claim 12 or 13, further comprising exposing means for exposing an image region where the developer image is formed by said developing means, wherein said control means controls the surface potential of the photosensitive body by controlling the charging bias together with operating said exposing means.

* * * * *

UNITED STATES PATENT AND TRADEMARK OFFICE

CERTIFICATE OF CORRECTION

PATENT NO. : 6,668,143 B2
DATED : December 23, 2003
INVENTOR(S) : Masahiro Ito

It is certified that error appears in the above-identified patent and that said Letters Patent is hereby corrected as shown below:

Column 8,
Line 19, “more” should read -- greater --; and
Line 39, “said” shoud read -- said to be --.

Column 10,
Line 30, “thousands” should read -- thousand --.

Column 12,
Line 39, “the” (first occurrence) should be deleted.

Signed and Sealed this

Twenty-second Day of June, 2004

JON W. DUDAS
*Acting Director of the United States Patent and Trademark Office*